United States Patent [19]

Briggs et al.

[11] 4,194,941

[45] Mar. 25, 1980

[54] LABELLING MACHINE

[75] Inventors: Peter D. Briggs, San Jose, Calif.; Dennis R. Sharkey, Tabik, South Africa

[73] Assignee: FMC Corporation, San Jose, Calif.

[21] Appl. No.: 490,824

[22] Filed: Jul. 22, 1974

[51] Int. Cl.[2] ..... B65C 9/04; B65C 9/32; B65C 9/42

[52] U.S. Cl. ..... 156/361; 156/364; 156/449; 156/484; 156/542; 156/556; 156/584; 156/DIG. 26; 156/DIG. 33; 156/DIG. 40; 156/DIG. 45

[58] Field of Search ..... 156/212, 361, 475, 483, 156/484, 485, 541, 542, 566, 486, 364, 368, 446, 449, 556, 584, DIG. 26, DIG. 33, DIG. 40, DIG. 45

[56] References Cited

U.S. PATENT DOCUMENTS

| | | | |
|---|---|---|---|
| 1,981,278 | 11/1934 | Mudd | 156/566 |
| 2,346,142 | 4/1944 | Anderson | 156/483 |
| 2,596,158 | 5/1952 | Lindsey | 156/486 |
| 2,862,638 | 12/1958 | Banks | 156/449 |
| 3,321,105 | 5/1967 | Marano | 156/361 |
| 3,405,021 | 10/1968 | Marano | 156/542 |
| 3,436,294 | 4/1969 | Marano | 156/542 |
| 3,658,630 | 4/1972 | Stauber | 156/566 |
| 3,676,257 | 7/1972 | Ingalls | 156/542 |
| 3,690,996 | 9/1972 | Runzi | 156/542 |
| 3,944,455 | 3/1976 | French | 156/361 |

*Primary Examiner*—Michael G. Wityshyn
*Attorney, Agent, or Firm*—F. W. Anderson; C. E. Tripp

[57] ABSTRACT

A mechanism for automatically labelling articles, such as fruit, has a chute for guiding fruit into contact with an upstanding label, the engagement of the fruit with the label being effective to transfer the label to the fruit and to cause the movement of a new label into transfer position.

7 Claims, 4 Drawing Figures

LABELLING MACHINE

BACKGROUND OF THE INVENTION

Machines for applying labels to articles as they are moved through the machine have been used extensively in connection with the processing of cans, bottles and articles of fairly uniform configuration. In this type of machine the movement of the article is often used to contact a lever or star wheel or the like to actuate a mechanism for feeding the labels forwardly. The use of rollers and pressure members to press the labels onto articles is also a common expedient. While these mechanisms have been effective in applying labels to moving objects of fairly uniform configuration, their use with rolling fruit or the like has met with little commercial success.

It is therefore an object of the present invention to provide a machine for effectively applying labels to objects having configurations, such as fruit, while the objects are being advanced along a predetermined path.

A further object is to provide an improved roller mechanism for effecting the smooth transfer of labels to moving objects.

SUMMARY OF THE INVENTION

The labelling machine of the present invention comprises a runway having a transverse opening in its lower wall or floor. A feed mechanism, that is intermittently driven, advances a tape having a plurality of spaced labels thereon around the upper edge of a stripper plate, which is mounted directly below the opening in the runway. As the tape is drawn over the upper edge of the stripper plate, a label is peeled from the tape and is projected upwardly through the opening.

An article to be labelled, such as an apple, rolling down the runway, engages the projecting end portion of the label and pulls it free from the tape. Means are provided so that the tape will be automatically advanced when each article receives a label whereby every article moving down the chute will receive a label.

After the article picks off the label, it is engaged by a driven lower roller, and the action of the roller is such that the direction of rotation of the article is reversed and the label is smoothly rolled onto the article.

DESCRIPTION OF A PREFERRED EMBODIMENT

Figure 1:
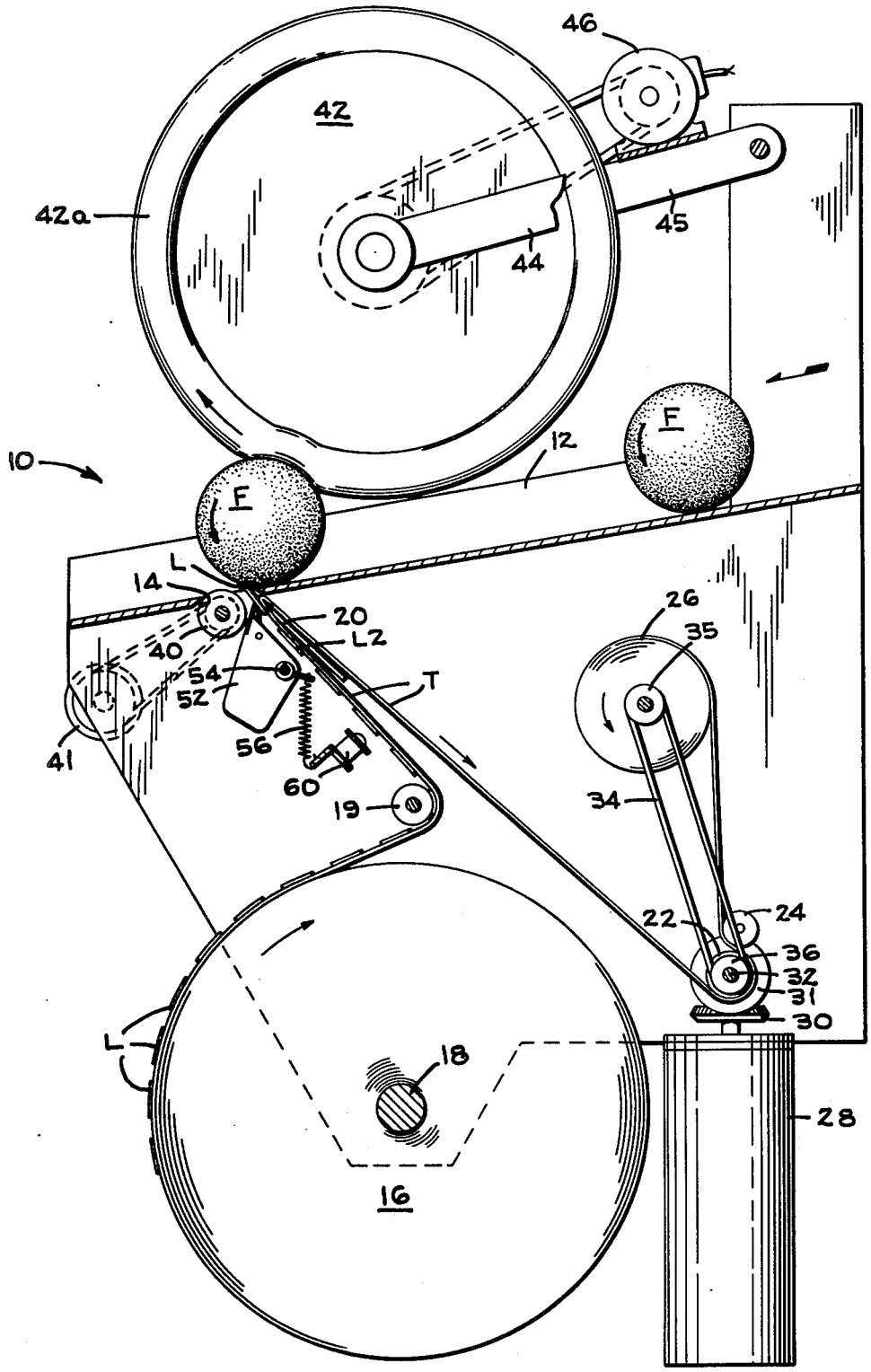
FIG. 1 is a schematic side elevation, partly in section of the labelling unit of the present invention.

In FIG. 1, the reference numeral 10 indicates a labelling unit having a downwardly inclined chute with opposed sidewalls 12, one only being shown. Generally cylindrical fruit F, such as oranges or apples, are directed downwardly along the chute to pass over a transfer slot 14 provided in the bottom wall of the chute. Labels L, which are carried in spaced relation on a tape T, are fed upwardly through the slot 14 to a position in front of the downwardly moving fruit so that the fruit will contact the sticky side of the label, causing the label to be rolled onto the fruit.

The tape T is unwound from a supply roll 16 that is freely rotatable on a spindle 18. The tape is trained around a guide roller 19 and then upwardly to a rigid stripper blade 20 that has an upper rounded edge around which the tape is bent. The tape is then directed downwardly around a drive roller 22, under a pressure roller 24, and then upwardly to a rewind reel 26. The pressure roller 24 urges the tape against the drive roller 22 which is driven by a motor 28 through bevel gears 30 and 31, gear 31 being keyed to a shaft 32 to which the drive roller 22 is also keyed. The motor 28 also drives the rewind reel 26 through a belt 34 that is trained over two pulleys 35 and 36, pulley 36 being keyed to shaft 32.

Figure 2:
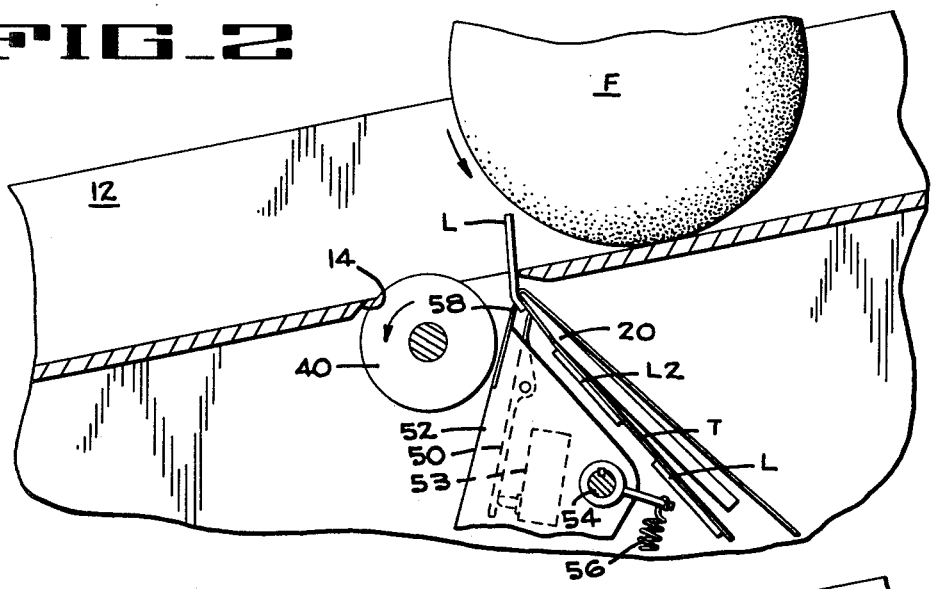
FIGS. 2, 3 and 4 are fragmentary schematic side elevations showing progressive steps in feeding, positioning and transfer of a label to a piece of fruit.

Referring to FIG. 2, it will be noted that, when the tape is drawn by drive roller 22 around the upper edge of the stripper blade 20, the label L adjacent the edge is peeled off and projects upwardly through the slot 14 into the path of fruit moving down the chute. As will be explained presently, the drive roller 22 is intermittently actuated to move the tape and FIG. 2 represents a position at which the tape is at rest with the label projecting upwardly.

Figure 3:
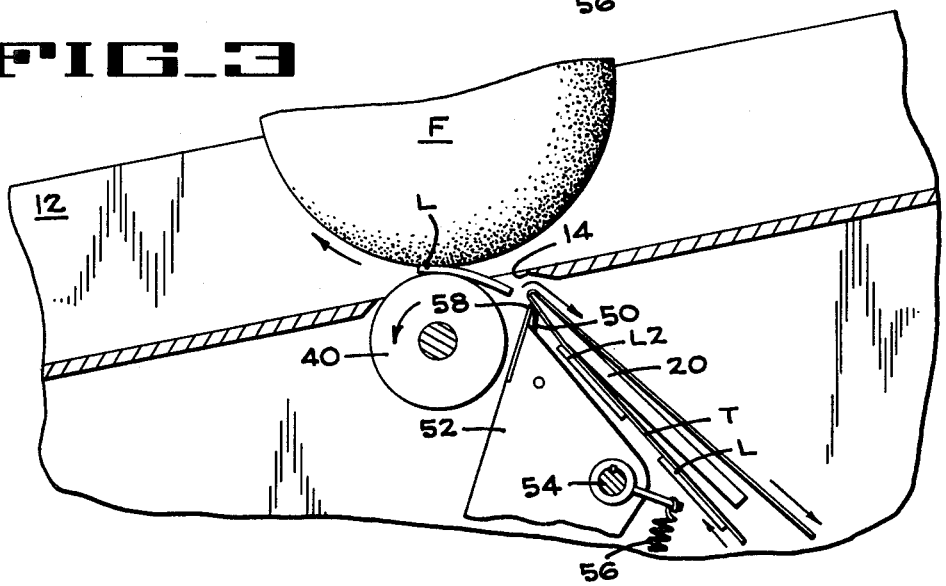
Figure 4:
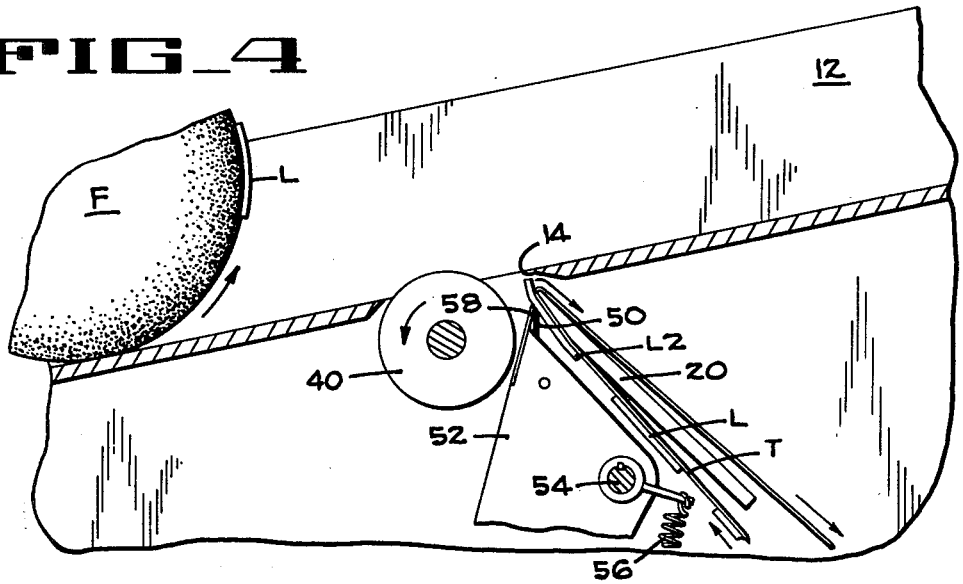

Also projecting partially through the slot 14 (FIG. 1) is a soft rubber roller 40 which is continuously driven in a counterclockwise direction by a motor 41. Before the fruit reaches the small roller 40 it is under the control of an overhead hold-down roller 42 which is rotatably mounted on the end of a pair of freely-pivoted identical arms 44 and 45 and continuously driven in a clockwise direction by a motor 46. The small roller 40 is rotated sufficiently faster than is the overhead roller 42 so that, when a fruit is in contact with both rollers, the fruit will be momentarily rotated in a clockwise direction (FIG. 3). This action causes the label to be effectively rolled onto the fruit.

The overhead roller 42 has an inflatable peripheral portion **42*a* that bears against the fruit, while the small roller 40** is profiled in accordance with the general shape of the articles that are being labelled. Thus, in the case of generally spherical fruit, the small roller will have a concave profile conforming approximately to the curvature of fruit of this type.

As previously mentioned, the tape T is intermittently advanced. This is accomplished by means of a switch actuator 50 (FIG. 2) that is pivotally mounted inside the housing 52 of a microswitch. The housing itself is pivoted by pin 54 on the frame of the labelling unit 10, and is urged in a clockwise direction by a spring 56. A detector arm 58 is carried at the upper end of the housing 52 and it will be noted that, when the tape is at rest and the label L is projecting upwardly, the end of the detector arm is resting on the lower end portion of the label that is still attached to the tape T. At this time the end of the actuator 50 of the switch is spring-urged clockwise to a position resting against the tape at a point between adjacent labels.

The fruit moving down the chute engages the label and moves it toward the left to complete its separation from the tape and to advance the tape slightly. This slight advance of the tape causes the detector to move out of engagement with the lower end of the label that is being removed. As a result, the housing 52 pivots slightly in a clockwise direction to the FIG. 3 position. Since the switch actuator arm 50 is abutting the tape already, it cannot pivot with the housing and, accordingly, it pivots internally of the housing in a counterclockwise direction relative to the housing to operate contacts in a switch 53 which close a circuit and energize the motor 28 to rotate the drive roller 22 and advance the tape. Thus, detector 58 and switch actuator arm 50 comprise a means for sensing the presence of a fruit on the fruit supporting surface of the chute to initiate the advancement of the tape. Accordingly, when the detector 58 reaches the position shown in FIG. 3, the tape is advanced. The next label on the tape, indicated as L2 in FIG. 3, engages the switch actuator 50 and pivots it counterclockwise relative to the housing. Since counterclockwise movement of the actuator has already closed the switch, this second counterclockwise movement causes no further control action to occur as the label L2 rides up under the actuator. This second counterclockwise movement is very small and the switch is constructed to absorb this small override of the closed-contact position without the contact being broken. If the override-absorbing capacity of the switch is not enough, the housing 52 will pivot slightly in a counterclockwise direction.

As the label L2 continues upwardly it engages the detector 58 and pivots the housing counterclockwise to allow the label to pass under the detector. When the lower end of the label passes out from under the actuator 50, the actuator is spring-urged to its FIG. 1 position, opening the circuit to the motor 28 and stopping the feeding movement of the tape. The label L2 comes to rest in the position indicated for label L in FIG. 2.

A retro-reflective photoelectric cell 60 is provided adjacent the tape T and forms a holding circuit for the motor 28 as long as the tape is detected by photoelectric cell. When the supply roll 16 is depleted and the end of the tape passes beyond the photoelectric cell, the circuit to the motor 28 is opened to deenergize the motor and to turn on a warning light (not shown).

It will be evident that other drive systems may be used. For example, a single motor could be used to rotate the rollers 40 and 42 at their desired speed and to rotate a driving member of a clutch at a fixed speed. The actuator 50 then would be effected to energize and deenergize the clutch to engage the driving member with the tape drive roller 22.

A particular feature of the invention is the use of the removal of the label from the tape by the article itself to cause the positioning of the next label. Further the interaction of the two rollers in effecting the smooth application of the label to the article makes possible the effective labelling of articles such as fruit, that do not have completely uniform surfaces for receiving the label.

It will be understood that modifications and variations of the mechanism may be effected without departing from the scope of the invention.

What is claimed is:

1. A labelling machine comprising means providing a surface for supporting rollable articles for rotational movement thereover, means defining an opening in said surface, a tape support member mounted within said machine so that an edge thereof extends below and directly adjacent to said opening, means for mounting a tape having uniformly spaced labels thereon for movement along a path within said machine, said path extending around said edge of said support member so that said edge serves to successively separate said labels from said tape by forcing said labels to follow a secondary path which diverges from said tape path and extends through said opening into the path of said rollable articles, drive means for moving said tape along its said path, means for starting and stopping said drive means so that each article rolling on said surface will receive a label which has been projected through said opening and cause it to partially adhere thereto, a roller mounted below said surface and having a peripheral portion projecting through said opening in spaced relation to said projected label and downstream thereof to engage an article moving along said surface and the label partially adhering to said article, a second roller disposed above said surface for engaging an upper portion of an article moving along said surface, and means for rotating said rollers at speeds such that the peripheral speed of the lower roller is greater than the peripheral speed of said upper roller, whereby the lower roller will reverse the direction of rotation of the article to roll the label onto the article.

2. A labelling machine as set forth in claim 1 wherein both of said rollers are comprised of resilient material which will at least partially conform to the surface of the article during engagement therewith.

3. A labelling machine as set forth in claim 1 wherein said upper roller has a substantially greater diameter than that of said lower roller.

4. A labelling machine as set forth in claim 1 wherein surface for supporting said articles is inclined with respect to the horizontal so that said articles may roll down said surface under the influence of gravity until they are forceably engaged by said upper roller.

5. A labelling machine comprising an article supporting runway having a flat surface for supporting generally round articles for rotational movement thereover, said surface having an opening therein, a tape support member mounted within said machine so that an edge thereof extends below and directly adjacent to said opening, means for mounting a tape having uniformly spaced labels thereon for movement along a path within said machine, said path extending around said edge of said tape support member so that said edge serves to successively separate said labels from said tape by forcing said labels to follow a secondary path which diverges from said tape path and extends through said opening into the path of said rollable articles, drive means for moving said tape along its said path, means for sensing the presence of an article on said surface, and means connected to said sensing means for starting and stopping said drive means so that each article rolling on said surface will receive a label which has been projected through said opening and cause it to partially adhere thereto, a roller mounted below said surface adjacent said opening in spaced relation to said projected label and downstream thereof for engaging an article moving along said surface and the label partially adhering to said article, means resiliently engaging each article from above as the article passes over said opening to press said article against said roller, and means for rotating said roller at a speed so that the direction of rotation of the article on the surface is reversed in order to roll the label onto the article.

6. A labelling machine as set forth in claim 5 wherein said roller is comprised of resilient material which will at least partially conform to the surface of the article during engagement therewith.

7. A labelling machine as set forth in claim 5 wherein said runway is inclined with respect to the horizontal so that said articles may be gravitationally impelled thereon.

* * * * *